US012428715B2

(12) United States Patent
Langan et al.

(10) Patent No.: US 12,428,715 B2
(45) Date of Patent: Sep. 30, 2025

(54) HEAT TREATMENT OF ALUMINUM ALLOYS CONTAINING SILICON AND SCANDIUM

(71) Applicant: Clean TeQ Holdings Limited, Notting Hill (AU)

(72) Inventors: Timothy J. Langan, Catonsville, MD (US); Thomas Dorin, Yarraville (AU)

(73) Assignee: SRL Holding Company Pty Ltd, Melbourne (AU)

( * ) Notice: Subject to any disclaimer, the term of this patent is extended or adjusted under 35 U.S.C. 154(b) by 156 days.

(21) Appl. No.: 16/276,114

(22) Filed: Feb. 14, 2019

(65) Prior Publication Data

US 2019/0249283 A1 Aug. 15, 2019

Related U.S. Application Data

(60) Provisional application No. 62/630,450, filed on Feb. 14, 2018.

(51) Int. Cl.

| | |
|---|---|
| ***C22F 1/043*** | (2006.01) |
| ***C22C 21/02*** | (2006.01) |
| ***C22C 21/08*** | (2006.01) |

(52) U.S. Cl.

CPC ..... *C22F 1/043* (2013.01); *C22C 21/02* (2013.01); *C22C 21/08* (2013.01)

(58) Field of Classification Search

CPC ..... C22F 1/04–057

See application file for complete search history.

(56) References Cited

U.S. PATENT DOCUMENTS 3,619,181 A * 11/1971 Willey ..... C22C 21/00 420/538
5,620,652 A * 4/1997 Tack ..... C22C 21/16 420/532

(Continued)

FOREIGN PATENT DOCUMENTS

CN 106636812 A * 5/2017
DE 102007018123 A1 10/2008

(Continued)

OTHER PUBLICATIONS

Kwon E., et al.; "The Effect of an Addition of Sc and Zr on the Precipitation Behavior of AA6061 Alloy", Met. Mater. Int.; vol. 16; No. 5; 2010, pp. 701-707 (Year: 2010).*

(Continued)

*Primary Examiner* — Sally A Merkling
*Assistant Examiner* — Austin Pollock
(74) *Attorney, Agent, or Firm* — Alan G. Towner; Leech Tishman Fuscaldo & Lampl

(57) ABSTRACT

Heat treatment of aluminum alloys containing Si with Sc additions improves mechanical properties of the alloys by the formation of Sc-containing dispersoids. The Al—Si—Sc alloys may include Zr or other refractory metals, and may also include Mg, Cu and/or Cr. Depending upon the cooling rate used during casting, at least some of the Sc-containing dispersoids may be present upon casting and cooling of the Al—Si alloy, in which case it may be desirable to reduce or eliminate coarsening of the as-cast dispersoids upon subsequent heat treatment. The subsequent heat treatment may also generate fresh Sc-containing dispersoids. Alternatively, the as-cast Al—Si alloy may not include Sc-containing dispersoids upon cooling, in which case the Sc-containing dispersoids may form during the heat treatment process.

31 Claims, 7 Drawing Sheets

(56) References Cited

U.S. PATENT DOCUMENTS

| | | | | |
|---|---|---|---|---|
| 5,624,632 | A * | 4/1997 | Baumann | C22C 21/06 420/544 |
| 6,679,958 | B1 * | 1/2004 | Tundal | C22F 1/05 148/690 |
| 7,048,815 | B2 | 5/2006 | Senkov et al. | |
| 2001/0054247 | A1 * | 12/2001 | Stall | F41C 23/18 42/106 |
| 2002/0157742 | A1 * | 10/2002 | Cho | C22C 21/10 148/701 |
| 2007/0240796 | A1 | 10/2007 | Koch et al. | |
| 2011/0061494 | A1 * | 3/2011 | Pandey | B22F 3/162 75/228 |
| 2013/0220497 | A1 * | 8/2013 | Huskamp | B22D 21/007 148/688 |
| 2014/0366998 | A1 * | 12/2014 | Kamat | B22D 11/003 148/688 |
| 2016/0115575 | A1 * | 4/2016 | Bull | B22D 7/005 148/417 |
| 2018/0363113 | A1 * | 12/2018 | Matsumoto | C22C 21/08 |

FOREIGN PATENT DOCUMENTS

| | | | |
|---|---|---|---|
| JP | 2010018854 | A * | 1/2010 |
| RU | 2221891 | C1 * | 1/2004 |

OTHER PUBLICATIONS

Litynska L.; et al. Experimental and theoretical characterization of Al3Sc precipitates in Al—Mg—Si—Cu—Sc—Zr alloys, 97 (2006) (Year: 2006).*

Litynska L.; et al.; "Precipitation of Phases in Al—Mg—Si—Cu Alloy with Sc and Zr Additions During Heat Treatment", Solid State Phenomena, vol. 130, 2007, pp. 163-166 (Year: 2007).*

Vlach M., et al.; "Microstructure and mechanical properties of the AA6082 aluminum alloy with small additions of Sc and Zr", Int. J. Mat. Res., 100, 2009 (Year: 2009).*

Morrison C., et al.; Role of Silicon in accelerating the nucleation of Al3(Sc,Zr) precipitates in dilute Al—Sc—Zr alloys, Acta Materialia, 60, 2012, p. 4740-4752 (Year: 2012).*

Vo N., et al.; "Role of silicon in the precipitation kinetics of dilute Al—Sc—Er—Zr alloys", Materials Science & Engineering, 677, 2016, p. 485-495 (Year: 2016).*

Morrison C., et al.; "Effect of Er additions on ambient and high-temperature strength of precipitation-strengthened Al—Zr—Sc—Si alloys" ; Acta Materialia, 60, 2012, p. 3643-3654 (Year: 2012).*

Kaiser M., et al.; "Thermal Analysis and Kinetics of the Precipitation in Wrought Al—Mg, Al—Mg—Sc, and Al—Mg—Sc—Me (Me=Zr, Ti) Alloys"; Iranian Journal of Materials Science & Engineering, vol. 10, No. 3, 2013 (Year: 2013).*

Shi Y., et al.; "Effect of Sc and Zr additions on corrosion behaviour of Al—Zn—Mg—Cu alloys", J. of Alloys and Compounds, 612, 2014, p. 42-50 (Year: 2014).*

Vlach M., et al. "Heat treatment and age hardening of Al—Si—Mg—Mn commercial alloy with addition of Sc and Zr", Materials Characterization, 129, 2017, p. 1-8 (Year: 2017).*

Vlach M., et al.; "Microstructure and mechanical properties of the AA6082 aluminum alloy with small additions of Sc and Zr", Int. J. Mat. Res., 100, (Year: 2009).*

Meng Y., et al.; "Effect of minor Zr and Sc on microstructures and mechanical properties of Al—Mg—Si—Cu—Cr—V alloys", Trans. Nonferrous Met. Soc. China, 23, p. 1882-1889 (Year: 2013).*

Ferralloy; "Ingot vs Billet"; https://www.ferralloy.com/post/ingot-vs-billet-understanding-the-differences-and-applications, retrieved from internet on Oct. 30, 2023 (Year: 2023).*

Litynska L., et al.; "Structure and properties of Al—Mg—Si alloys with Zr and Sc additions produced by melt spinning and twin rolling casting techniques"; Kovove Mater., 48, 2010 (Year: 2010).*

* cited by examiner 0091 (Al-0.1Sc-0.2Zr)

0.1 Sc

*Al-0.5Si-0.1Sc-0.2Zr* (0092)

Effect of homogenizing at 570°C before aging on Al-Sc-Zr alloys with Si.

HEAT TREATMENT OF ALUMINUM ALLOYS CONTAINING SILICON AND SCANDIUM

CROSS-REFERENCE TO RELATED APPLICATION

This application claims priority from U.S. Provisional Application No. 62/630,450, filed Feb. 14, 2018, which is incorporated herein by reference.

FIELD OF THE INVENTION

The present invention relates to heat treatment of Al—Si alloys, and more particularly relates to the formation of Sc-containing dispersoids in aluminum alloys containing Si additions.

BACKGROUND INFORMATION

U.S. Pat. No. 3,619,181 to Willey discloses that tensile properties of aluminum alloys containing small amounts of scandium improve after "aging". For example, the yield strength in pure aluminum with 0.14 wt % Sc increased from 6.9 ksi in the as cast condition to 15.6 ksi after aging for 8 hours at 288° C. This aging had little effect on the pure aluminum base alloy with strengths of 5.7 ksi in the cast condition and 6.9 ksi after aging. Willey also describes multiple step heat treatments where the cold worked alloy is treated at temperatures that range from 590-639° C. water quenched and then aged for 8 hours at 285-290° C.

U.S. Pat. No. 7,048,815 to Senkov et al. discloses that a stable dispersoid phase can be formed in an Al—Zr—Mg—Cu alloy containing a combination of Sc and Zr. In this work, a two-step heat treatment is used after solidification from the melt to precipitate and stabilize the scandium-containing phase.

U.S. Pat. No. 5,624,632 to Baumann et al. discloses the utilization of a two-step homogenization treatment to produce high mechanical properties in scandium-containing Al—Mg (Mn) alloys.

U.S. Patent Application Publication No. 2007/0240796 to Koch et al. discloses that aging increases the tensile yield strength in scandium-containing Al—Si—Mg casting alloys. In this disclosure, castings were subjected to a single step aging treatment 300° C. from the as cast condition.

Prior work included two-step heat treatments to nucleate, precipitate and stabilize this dispersoid phase. An example of such a known heat treatment process is shown in FIG. 1. It was known that Zr may be added in combination with the Sc to form stable dispersoids. In these examples, the Sc atoms remain in solution during solidification and cooling of the alloy. As shown in FIG. 1, a first treatment step is selected to nucleate a uniform dispersion of fine Al—Sc-containing dispersoids. The phase formed during this treatment has been defined as $Al_3Sc$ in Al, AlMg, and AlMgZn alloys. If not stabilized, this phase will coarsen during subsequent heat treatment and thermomechanical processing steps conventionally used to fabricate aluminum alloys. Thus, a second step treatment, as shown in FIG. 1, has been used to stabilize the dispersoids. Prior efforts have demonstrated that a Zr/Sc-containing shell is precipitated on the outside of the Sc-containing phase during the second heat treatment step. Once this shell layer forms it stabilizes the Sc-containing phase, preventing it from coarsening during subsequent processing (e.g., solution heat treatment, hot rolling, annealing, extruding, forging, hot drawing, brazing and the like).

SUMMARY OF THE INVENTION

The present invention provides heat treatment of aluminum alloys containing Si with Sc additions that improves mechanical properties of the alloys by the formation of Sc-containing dispersoids. The Al—Si—Sc alloys include at least one refractory metal such as Zr, Ti, Hf or V, and/or at least one rare earth element. Furthermore, the Al—Si—Sc alloys typically contain Mg, and may also include Cu and/or Cr. At least some of the Sc-containing dispersoids may be present upon casting and cooling of the Al—Si alloy, in which case it is desirable to reduce or eliminate coarsening of the as-cast dispersoids upon subsequent heat treatment. The subsequent heat treatment may also generate fresh Sc-containing dispersoids. Alternatively, the as-cast Al—Si alloy may not include Sc-containing dispersoids upon cooling, in which case the Sc-containing dispersoids may form during the heat treatment process.

In the present invention, scandium combines with aluminum to form a dispersoid phase that imparts beneficial properties on aluminum and aluminum alloys. These include controlled grain and sub-grain structure, strengthening due to impeded dislocation motion in the crystal, lattice and refined nucleation of secondary strengthening precipitates in aluminum alloys. For these effects to be maximized the size and distribution of the scandium containing dispersoids should be optimized.

An aspect of the present invention is to provide a method of heat treating an aluminum alloy comprising silicon and scandium, the method comprising heat treating an as-cast billet of the Al—Si—Sc alloy to a dispersoid precipitation temperature sufficient to precipitate Sc-containing dispersoids in the aluminum alloy, and cooling the billet.

Another aspect of the present invention is to provide a heat treated aluminum alloy billet comprising silicon and scandium with Sc-containing dispersoids therein.

These and other aspects of the present invention will be more apparent from the following description.

DETAILED DESCRIPTION

Figure 1:
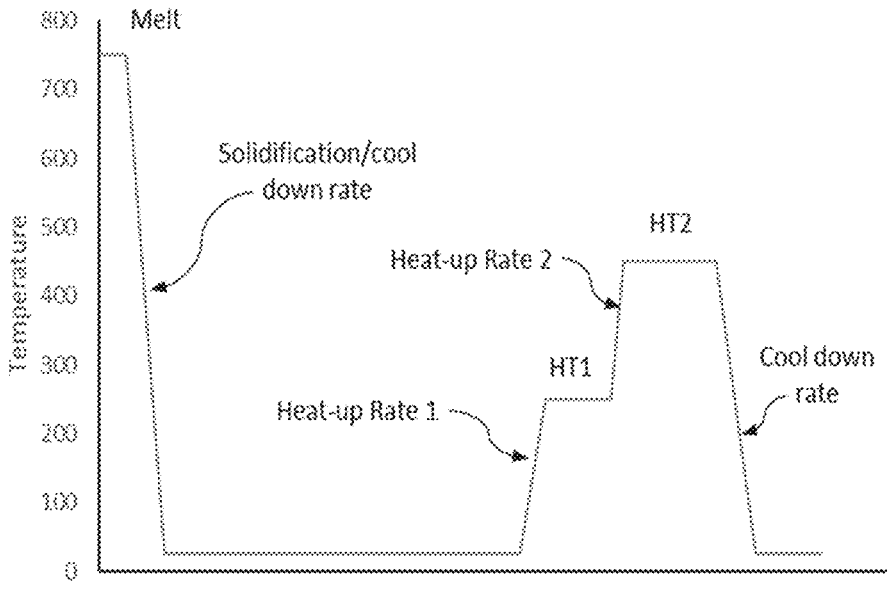
FIG. 1 illustrates a conventional heat treating process for aluminum-scandium-zirconium alloys.

The heat treatment processes of the present invention may be used with aluminum alloys containing Si, such as Al—Si, Al—Si—Sc, Al—Si—Sc—Zr, and the like. The aluminum alloys typically include Zr, and may also optionally include Mg, Cu and/or Cr. Other refractory metals such as Ti, Hf or V and/or rare earth elements can be used in combination with, or in place of, Zr. In certain embodiments, the aluminum alloys comprise Si-containing alloys such as Al—Si Aluminum Association 4XXX and Al—Mg—Si (Cu) Aluminum Association 6XXX series wrought alloys or modifications thereof. For example, 6XXX series alloys may include 6005, 6008, 6016, 6060, 6061, 6063, 6082 and 6111 alloys, and the like. The amount of Si contained in such alloys may range from 0.2 to 1.5 or 2 weight percent, and may vary based upon the specific 6XXX series alloy selected. Embodiments my also include alloys such as Al—Si—Mg (Cu) 3xx.x and Al—Si 4xx.x casting alloys. Such casting alloys may contain up to 15 or 20 weight percent Si, for example, from 0.2 to 15 weight percent.

In accordance with the present invention, the Al—Si alloy may typically contain Sc in an amount less than 0.5 weight percent, or less than 0.4 weight percent, or less than 0.2 weight percent. In certain embodiments, the amount of Sc is less than 0.1 weight percent, or less than 0.09 weight percent, or less than 0.08 weight percent, or less than 0.07 weight percent. The amount of Sc may typically range from 0.001 to 0.1 or 0.2 weight percent, for example, from 0.01 to 0.09 weight percent, or from 0.02 to 0.08 weight percent, or from 0.03 to 0.07 weight percent. In accordance with embodiments of the present invention, such amounts of Sc produce improved mechanical properties for the Al—Si alloys such as increased yield strength, in comparison with similar Al—Si alloys containing no Sc or larger amounts of Sc.

When Zr or another refractory metal or a rare earth element is present in the Al—Si—Sc alloys, the amount of such alloying addition(s) may typically range from 0.01 to 0.25 weight percent, for example, from 0.05 to 0.14 weight percent.

When Mg is present in the Al—Si—Sc alloys, it may be added in amounts of from 0.1 to 2 weight percent. When Cu is present in the Al—Si—Sc alloys, it may be added in amounts of from 0.1 to 2 weight percent. When Cr is present in the Al—Si—Sc alloys, it may be added in amounts of from 0.05 to 0.4 weight percent.

An embodiment of the present invention provides relatively slow cooling of a cast Al—Si alloy to precipitate Sc-containing dispersoids in the as-cast billet. Subsequent heat treatment can precipitate new Sc-containing dispersoids while reducing growth and coarsening of the as-cast Sc-containing dispersoids. When as-cast Sc-containing dispersoids are formed in the as-cast billet, they may be at least partially dissolved before the heat treatment process by performing a high-temperature homogenization process, as more fully described below.

In another embodiment, relatively fast cooling during casting may result in little or no as-cast Sc-containing dispersoids forming in the as-cast billet. Subsequent heat treatment is used to form the Sc-containing dispersoids in this embodiment.

In both of the embodiments described above, the Al—Si alloy billets may be homogenized and aged during the heat treatment process, and the resulting billets may subsequently be worked by any known techniques such as rolling, extruding, forging, and the like.

Figure 2:
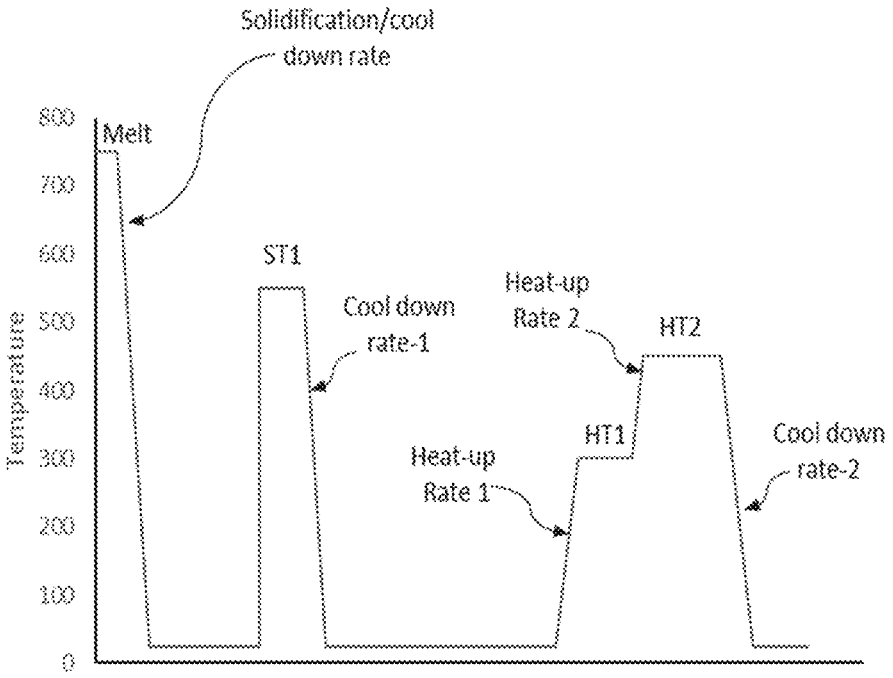
FIG. 2 illustrates a heat treatment process in accordance with an embodiment of the present invention.

In an embodiment of the present invention, shown in FIG. 2, a high temperature homogenization heat treatment (ST1) is used to dissolve the as-cast Sc-containing dispersoids which may form during solidification and cooling. Precipitation of Sc-containing dispersoids should be controlled during cool down from ST1, i.e., by controlling the Cool down rate-1. The temperature for this treatment may be selected based on the Sc and Si levels in the alloy, but is typically around 570° C. The temperature for this treatment can be reached in multiple steps or at a specified ramp rate to promote homogenization and prevent local melting. For example, the homogenization can be done in two steps: 10 hours at 550° C., then 4 hours at 570° C. After this treatment, the alloy is cooled at a rate sufficient to inhibit formation of Sc-containing dispersoid phases. The second step (HT1) of the treatment is used to precipitate dispersoids which may contain Sc and Si. The temperature for this treatment is selected to optimize nucleation and minimize growth of this phase. The third step (HT2) is selected to co-precipitate Sc and Zr as a shell on the Sc-containing dispersoids.

Figure 3:
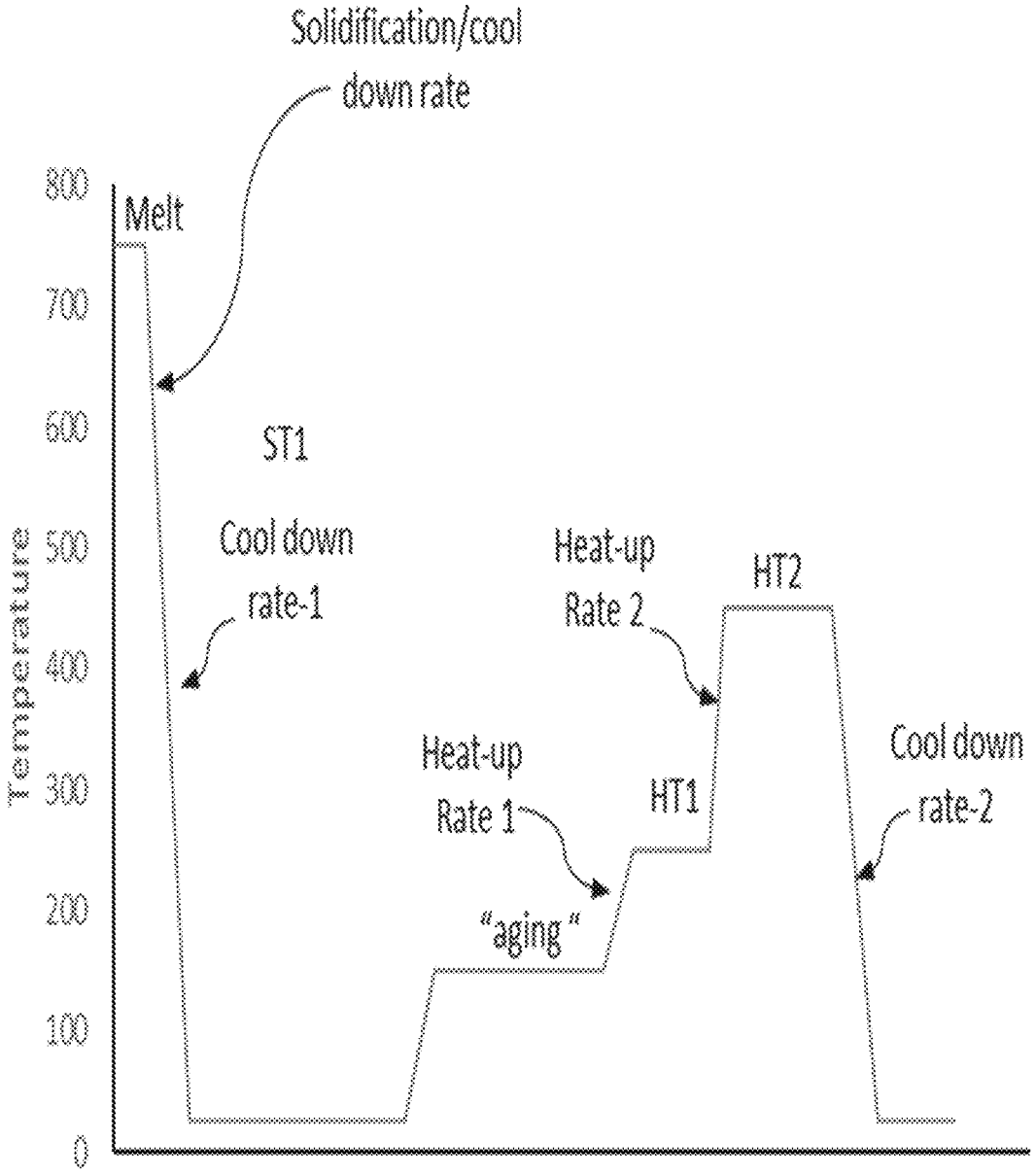
FIG. 3 illustrates a heat treatment process in accordance with another embodiment of the present invention.

In another embodiment of the invention shown in FIG. 3, a first step heat treatment is used to precipitate solute out of solution (everything but Sc and Zr) without coarsening the Sc-containing dispersoids. This step is typically done at temperatures between 100 and 225° C., for example, between 150 and 225° C., or between 170 and 200° C. The next step, HT1, precipitates the remaining scandium from solution into fine coherent dispersoids without undesirable coarsening of the as-cast Sc-containing dispersoids that may have formed during solidification or cooling. HT1 may typically be performed at temperatures between 225 and 350° C. Step HT2 is selected to co-precipitate Sc and Zr as a shell on the Sc-containing dispersoids. The typical temperature range for HT2 may be from 400 to 500° C.

In both embodiments of the invention, the ramps and holds can all or individually be replaced by a continuous ramp optimized to precipitate the Mg—Si, nucleate the Sc-containing dispersoids and then form a Zr rich outer shell.

Figure 4:
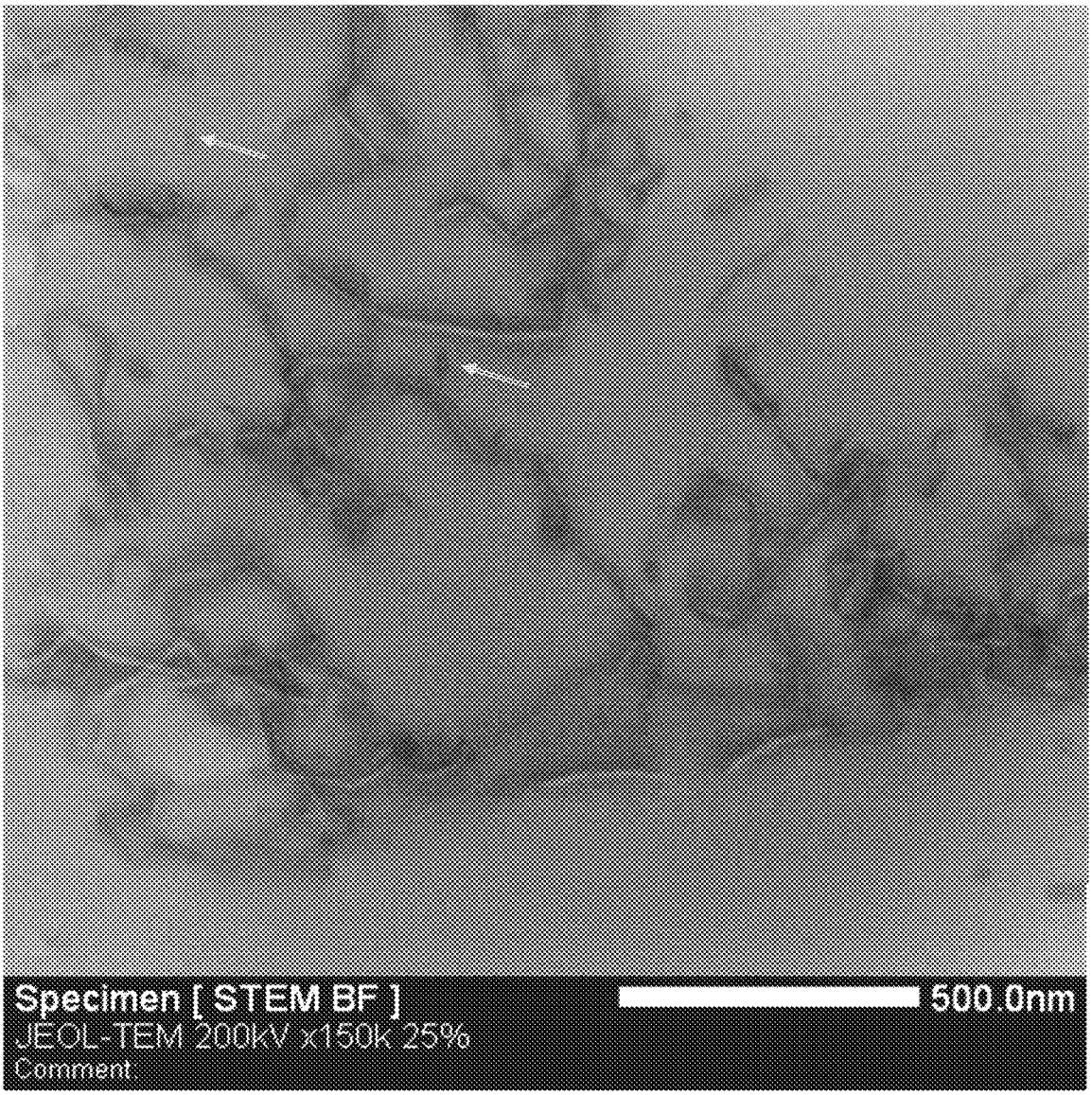
FIG. 4 is a photomicrograph of an aluminum-silicon-scandium alloy including relatively few scandium-containing dispersoids in accordance with an embodiment of the present invention.
Figure 5:
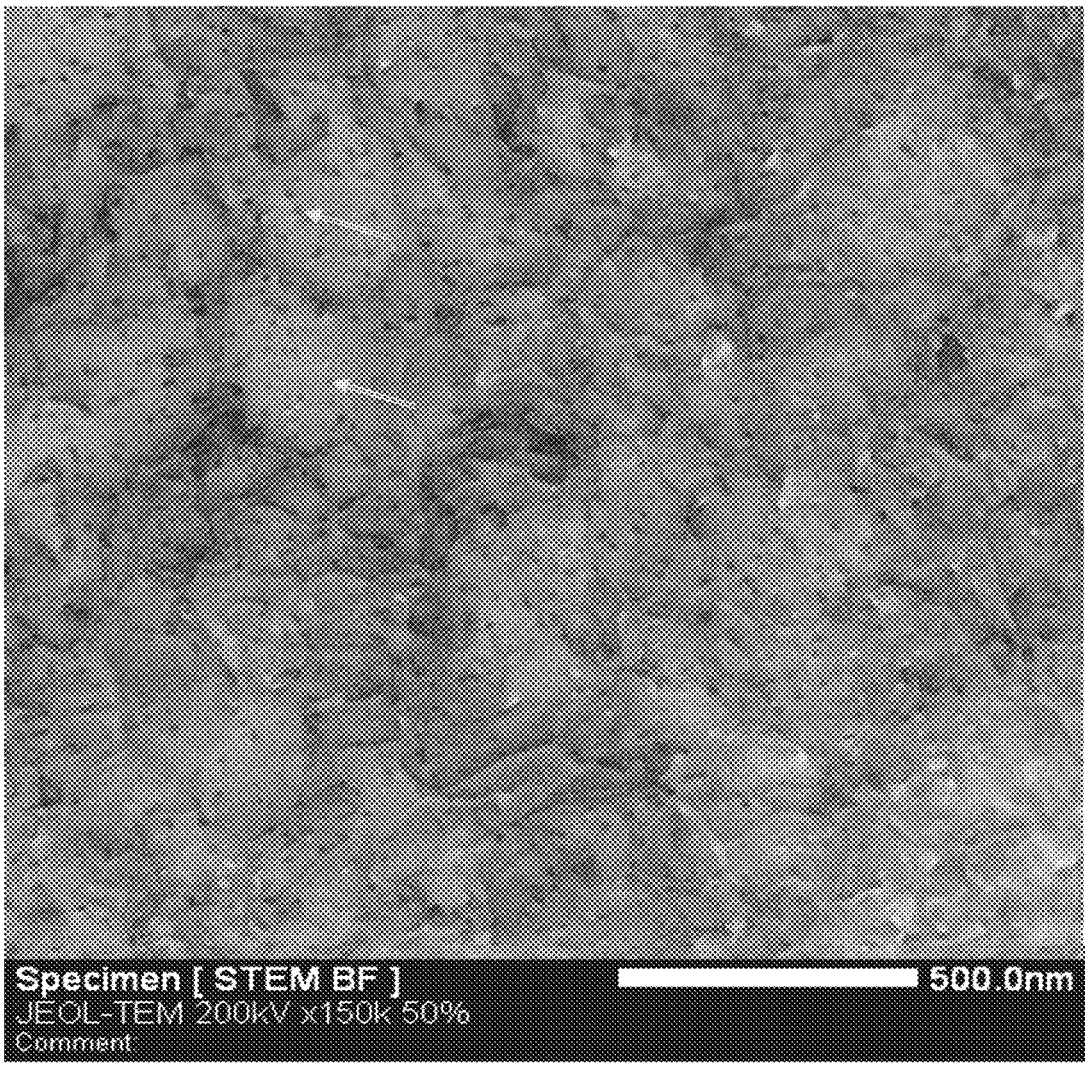
FIG. 5 is a photomicrograph of an aluminum-silicon-scandium alloy including a relatively large amount of scandium-containing dispersoids in accordance with an embodiment of the present invention.

The present invention provides heat treatments that optimize nucleation and stability of aluminum scandium dispersoids in silicon containing aluminum alloys. As shown in the micrograph of FIG. 4, very few Sc-containing dispersoid phases form during solidification and cooling in an aluminum alloy with 0.2 wt % Zr and 0.1 wt % Sc (no Si added). As shown in the micrograph of FIG. 5, much higher volume fractions of dispersoid phase are observed in an aluminum alloy containing 0.2 wt % Zr and 0.1 wt % Sc with 0.5 wt % Si. The Si may be present in the dispersoid phase and may enhance the nucleation of Sc-containing dispersoid phases that may form on solidification and/or cooling from the melt.

The following examples are intended to illustrate aspects of the present invention, and are not intended to limit the scope of the invention.

Example 1

Aluminum alloys 6061 and 6016 with and without scandium as listed in Table 1 below (weight percent) were heat treated as per the heat treatment process described below before hot rolling.

TABLE 1

| Alloy | Drop No. | | Mg | Si | Cu | Sc | Zr | Cr | Mn |
|---|---|---|---|---|---|---|---|---|---|
| 6061 | 071 | Target | 1.00 | 0.60 | 0.30 | | | 0.20 | 0.00 |
| | | Measured | 0.47 | 0.52 | 0.29 | | | 0.18 | |
| 6061 + Sc | 069 | Target | 1.00 | 0.60 | 0.30 | 0.05 | 0.10 | 0.00 | 0.00 |
| | | Measured | 0.45 | 0.54 | 0.31 | 0.05 | 0.11 | | |
| 6016 | 072 | Target | 0.32 | 1.00 | 0.00 | 0.00 | 0.00 | | 0.08 |
| | | Measured | 0.15 | 0.95 | | | | | 0.08 |
| 6016 + Sc | 070 | Target | 0.32 | 1.00 | 0.00 | 0.05 | 0.10 | | 0.00 |
| | | Measured | 0.15 | 0.92 | | 0.05 | 0.08 | | |

Heats # 069 and #070
Ramp up to 1022° F. (550° C.) at 15° F./min
Hold 10 hrs at 1022° F. (550° C.)
Ramp up to 1058° F. (570°) at 2° F./min
Hold 4 hrs at 1058° F. (570° C.)
Air Cool (as fast as possible)
Ramp up to 662° F. (350° C.) at 15° F./min
Hold ¾ hr at 662° F. (350° C.)
Ramp up to 932° F. (500° C.) at 15° F./min
Hold 2 hrs at 932° F. (500° C.)
Air Cool
Heats # 071 and #072
Ramp up to 1022° F. (550° C.) at 15° F./min
Hold 10 hrs at 1022° F. (550° C.)
Ramp up to 1058° F. (570°) at 2° F./min
Hold 4 hrs at 1058° F. (570° C.)
Air Cool (as fast as possible)

Figure 6:
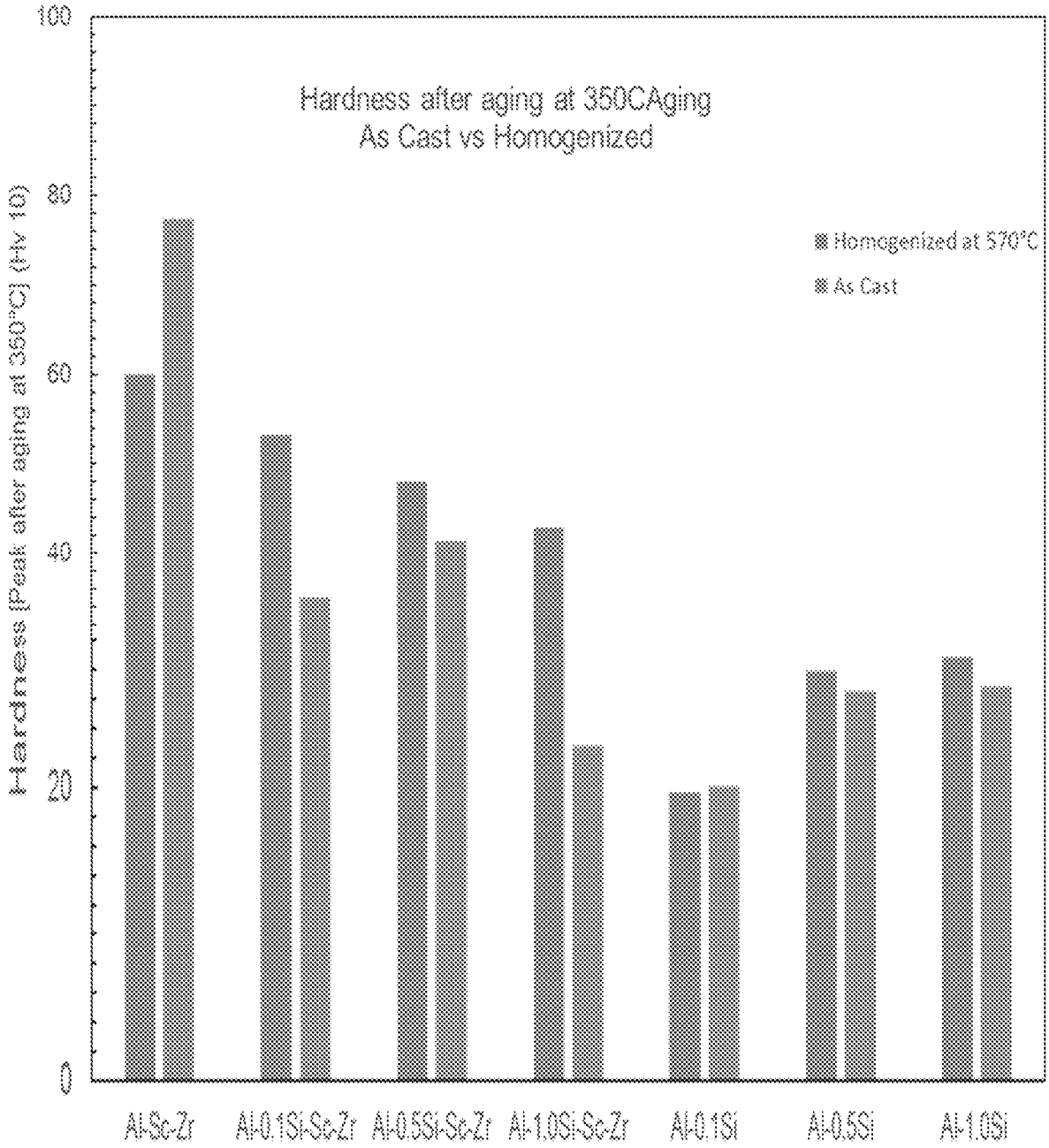
FIG. 6 is a graph illustrating hardness properties of various aluminum-zirconium and aluminum-silicon alloys after aging at 350° C. for as-cast and homogenized billets in accordance with an embodiment of the present invention.

Homogenizing at 570° C. before heat treating was shown to increase peak hardness in aluminum-scandium alloys containing Si. As shown in FIG. 6, the peak hardness is increased for Si containing alloys after aging at 350° C. if the alloy is first homogenized at 570° C. before aging. This effect is not observed in alloys not alloyed with Sc.

Example 2

Figure 7:
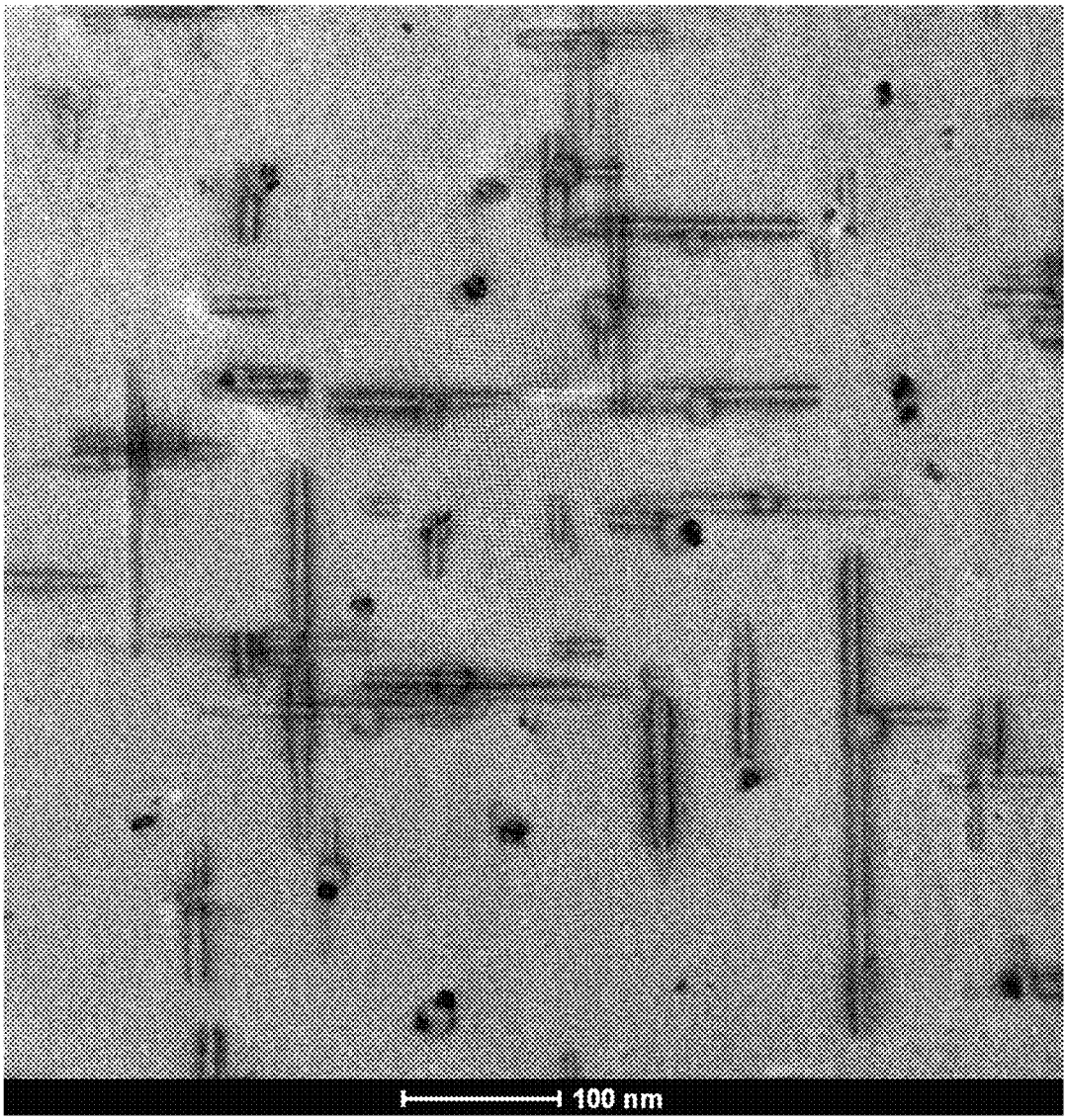
FIG. 7 is a photomicrograph of an aluminum-silicon-zirconium alloy including scandium-containing dispersoids in accordance with an embodiment of the present invention.

Alloy 6008 having a composition of 0.54 Si, 0.5 Mg, 0.08 Sc, 0.15Zr, 0.27 Cu, 0.195 Fe and 0.007 Mn (weight percent) was cast into a billet. The alloy was cast into a graphite mold supported by a non-actively cooled heat sink at a relatively slow cooling rate, which resulted in the precipitation of fine Sc-containing dispersoids. An HAADF image of the as-cast billet is shown in FIG. 7. The micrograph shows an aluminum matrix with rods of Mg/Si and Mg/Si/Cu in the x, y and z axes, and equiaxed Sc-containing dispersoids contacting the rods. During cooling, the Sc-containing dispersoids may act as nucleation sites for the Mg/Si(Cu) rods.

Figure 8:
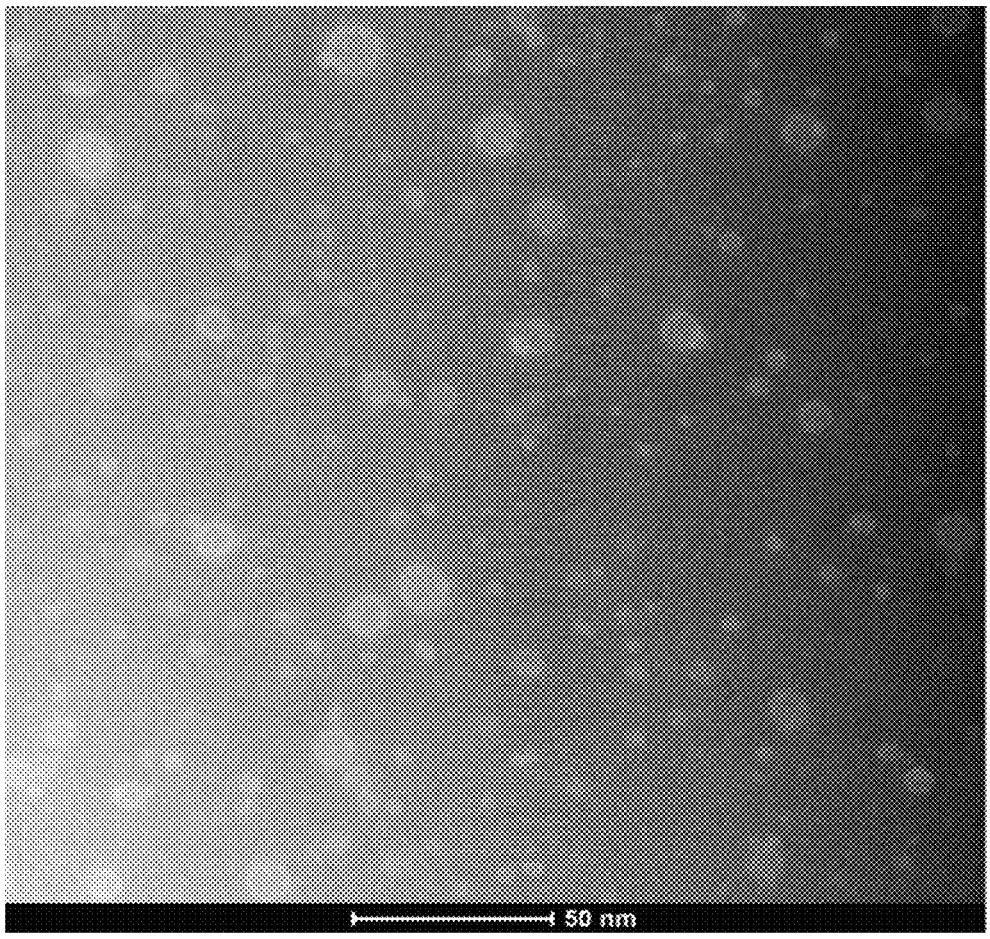
FIG. 8 is a photomicrograph of an aluminum-silicon-scandium alloy including scandium-containing dispersoids in accordance with another embodiment of the present invention.

The as-cast billet was then heat treated using a two-step process similar to that shown in FIG. 3 except eliminating the first HTI step and heating at a constant rate to HT2. Aging was performed for 12 hours at 190° C., and HT2 was held for 10 hours at 400° C. An HAADF image of the heat treated material is shown in FIG. 8. The micrograph shows a bi-modal distribution of Sc-containing dispersoids with no Mg/Si(Cu) rods. The larger Sc-containing dispersoids correspond to the original as-cast dispersoids with some grain growth, while the smaller Sc-containing dispersoids form during the heat treatment process.

For purposes of the description above, it is to be understood that the invention may assume various alternative variations and step sequences except where expressly specified to the contrary. Moreover, other than in any operating examples, or where otherwise indicated, all numbers expressing, for example, quantities of ingredients used in the specification and claims, are to be understood as being modified in all instances by the term "about". Accordingly, unless indicated to the contrary, the numerical parameters set forth are approximations that may vary depending upon the desired properties to be obtained by the present invention. At the very least, and not as an attempt to limit the application of the doctrine of equivalents, each numerical parameter should at least be construed in light of the number of reported significant digits and by applying ordinary rounding techniques.

It should be understood that any numerical range recited herein is intended to include all sub-ranges subsumed therein. For example, a range of "1 to 10" is intended to include all sub-ranges between (and including) the recited minimum value of 1 and the recited maximum value of 10, that is, having a minimum value equal to or greater than 1 and a maximum value of equal to or less than 10.

In this application, the use of the singular includes the plural and plural encompasses singular, unless specifically stated otherwise. In addition, in this application, the use of "or" means "and/or" unless specifically stated otherwise, even though "and/or" may be explicitly used in certain instances. In this application, the articles "a," "an," and "the" include plural referents unless expressly and unequivocally limited to one referent.

Whereas particular embodiments of this invention have been described above for purposes of illustration, it will be evident to those skilled in the art that numerous variations of the details of the present invention may be made without departing from the invention as defined in the appended claims.

What is claimed is:

1. A method of heat treating a 4XXX or a 6XXX aluminum alloy comprising silicon in an amount of at least 0.2 weight percent, zirconium in an amount of 0.25 weight percent or less, and scandium, the method comprising:

heating an as-cast billet of the 4XXX or 6XXX aluminum alloy to an aging temperature of at least 100° C. to produce an aged billet; and heat treating the aged billet to a dispersoid precipitation temperature sufficient to precipitate Sc-containing dispersoids in the 4XXX or 6XXX aluminum alloy to produce a heat treated billet, wherein the heat treating comprises performing in first and second stages, the first stage heat treatment is performed at a lower temperature than a higher temperature of the second stage heat treatment, the higher temperature of the second stage heat treatment is achieved by ramping up from the lower temperature of the first stage heat treatment to the higher temperature of the second stage heat treatment, and the aging temperature is less than the temperature of the first stage heat treatment.

2. The method of claim 1, wherein the aging temperature is from 150 to 225° C.

3. The method of claim 1, wherein the heat treating is performed at varying heat up rates.

4. The method of claim 1, wherein the 4XXX or 6XXX aluminum alloy further comprises zirconium, the first stage heat treatment causes precipitation of the Sc-containing dispersoids, and the second stage heat treatment causes precipitation of Zr-containing shells on the Sc-containing dispersoids.

5. The method of claim 1, wherein the first and second stage heat treatments are performed at substantially the same heat up rates.

6. The method of claim 1, wherein the first and second stage heat treatments are performed at different heat up rates.

7. The method of claim 1, wherein the as-cast billet is substantially free of Sc-containing dispersoids.

8. The method of claim 1, wherein the Si comprises from 0.2 to 2 weight percent.

9. The method of claim 1, wherein the Si comprises from 0.2 to 1 weight percent.

10. The method of claim 1, wherein the Si comprises from 0.2 to 0.6 weight percent.

11. The method of claim 1, wherein the 4XXX or 6XXX aluminum alloy further comprises Ti, Hf and V or a combination thereof.

12. The method of claim 1, wherein the 4XXX or 6XXX aluminum alloy further comprises at least one refractory metal or rare earth element.

13. The method of claim 1, wherein the 4XXX or 6XXX aluminum alloy further comprises Cu, Cr, Mg or a combination thereof.

14. The method of claim 1, wherein the 4XXX or 6XXX aluminum alloy is a 4XXX alloy.

15. The method of claim 1, wherein the 4XXX or 6XXX aluminum alloy is a 6XXX alloy.

16. The method of claim 1, wherein the lower temperature of the first stage heat treatment is from 225 to 350° C.

17. The method of claim 1, wherein the higher temperature of the second stage heat treatment is from 400 to 500° C.

18. The method of claim 1, further comprising cooling the heat treated billet.

19. The method of claim 1, wherein the 4XXX or 6XXX aluminum alloy further comprises Mg.

20. The method of claim 19, wherein the Mg comprises from 0.1 to 2 weight percent.

21. The method of claim 19, wherein the Mg is in an amount of 0.6 weight percent or less.

22. The method of claim 19, wherein the Mg comprises from 0.25 to 0.6 weight percent.

23. The method of claim 1, wherein the as-cast billet comprises as-cast Sc-containing dispersoids.

24. The method of claim 23, wherein at least a portion of the as-cast Sc-containing dispersoids are retained during the heat treating step.

25. The method of claim 23, wherein at least a portion of the as-cast Sc-containing dispersoids are dissolved prior to or during the heat treating step.

26. The method of claim 1, wherein the 4XXX or 6XXX aluminum alloy comprises from 0.001 to 0.5 weight percent scandium.

27. The method of claim 26, wherein the Sc comprises from 0.01 to 0.4 weight percent.

28. The method of claim 27, wherein the Sc comprises from 0.02 to 0.2 weight percent.

29. The method of claim 1, wherein Zr is from 0.05 to 0.25 weight percent.

30. The method of claim 29, wherein the Sc is from 0.1 to 0.2 weight percent.

31. The method of claim 29, wherein the Sc is from 0.03 to 0.1 weight percent.

* * * * *